US010519585B2

(12) United States Patent
Rockwell

(10) Patent No.: US 10,519,585 B2
(45) Date of Patent: Dec. 31, 2019

(54) APPLIANCE HAVING DAMPENING PORTION

(71) Applicant: Owens Corning Intellectual Capital, LLC, Toledo, OH (US)

(72) Inventor: Anthony L. Rockwell, Pickerington, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 410 days.

(21) Appl. No.: 15/348,001

(22) Filed: Nov. 10, 2016

(65) Prior Publication Data

US 2017/0058448 A1 Mar. 2, 2017

Related U.S. Application Data

(63) Continuation of application No. 13/499,756, filed as application No. PCT/US2011/020124 on Jan. 4, 2011, now Pat. No. 9,506,181.

(60) Provisional application No. 61/292,280, filed on Jan. 5, 2010.

(51) Int. Cl.

| | |
|---|---|
| ***D06F 39/00*** | (2006.01) |
| ***D06F 37/26*** | (2006.01) |
| ***B65D 81/07*** | (2006.01) |
| ***B65D 85/68*** | (2006.01) |

(52) U.S. Cl.

CPC ..... *D06F 39/001* (2013.01); *B65D 81/07* (2013.01); *B65D 85/68* (2013.01); *D06F 37/262* (2013.01); *D06F 37/267* (2013.01); *B65D 2585/6815* (2013.01); *B65D 2585/6855* (2013.01); *Y10T 29/49826* (2015.01)

(58) Field of Classification Search

None

See application file for complete search history.

(56) References Cited

U.S. PATENT DOCUMENTS

| | | | |
|---|---|---|---|
| 2,231,063 | A | 6/1943 | Bohnke |
| 2,703,974 | A | 3/1955 | Clark et al. |
| 2,879,655 | A | 3/1959 | McCormick |
| 3,132,098 | A | 5/1964 | Bochan |
| 3,216,225 | A | 11/1965 | Gil |

(Continued)

FOREIGN PATENT DOCUMENTS

| | | |
|---|---|---|
| AU | 2002301525 | 12/2003 |
| DE | 2531265 | 1/1977 |

(Continued)

OTHER PUBLICATIONS

Notice of Allowance from U.S. Appl. No. 13/114,446 dated Apr. 5, 2017.

(Continued)

*Primary Examiner* — Rita P Adhlakha

(74) *Attorney, Agent, or Firm* — Calfee, Halter & Griswold LLP

(57) ABSTRACT

Systems for shipping and operation dampening an appliance having a housing, a moveable tub member inside the housing, and a dampening portion are provided. The housing includes at least one sidewall, with the dampening portion disposed at least partially between the moveable tub member and the at least one side wall. The dampening portion includes a resilient material having at least one surface extending at least partially along the sidewall or tub member.

9 Claims, 9 Drawing Sheets

(56) References Cited

U.S. PATENT DOCUMENTS

| | | | | |
|---|---|---|---|---|
| 3,268,082 | A | 8/1966 | Galin | |
| 3,301,428 | A | 1/1967 | Erickson | |
| 3,579,609 | A * | 5/1971 | Sevenich | C08L 67/02 264/210.6 |
| 4,366,902 | A | 1/1983 | Fanson et al. | |
| 5,056,341 | A | 10/1991 | Mori et al. | |
| 5,307,928 | A | 5/1994 | Bishop | |
| 5,533,367 | A | 7/1996 | Lybarger et al. | |
| 5,570,597 | A | 11/1996 | Bongini | |
| 5,647,257 | A | 7/1997 | Maida et al. | |
| 5,679,145 | A | 10/1997 | Andersen et al. | |
| 5,855,353 | A | 1/1999 | Shaffer et al. | |
| 5,934,107 | A | 8/1999 | Lee et al. | |
| 6,196,029 | B1 | 3/2001 | Melia et al. | |
| 6,539,955 | B1 | 4/2003 | Tilton et al. | |
| 6,669,265 | B2 | 12/2003 | Tilton et al. | |
| 6,807,700 | B2 | 10/2004 | Panther et al. | |
| 7,014,160 | B2 | 3/2006 | Muyskens | |
| 7,128,561 | B2 | 10/2006 | Rockwell et al. | |
| 7,159,836 | B2 | 1/2007 | Parks et al. | |
| 7,226,879 | B2 | 6/2007 | Tilton et al. | |
| 7,251,962 | B2 | 8/2007 | Lim et al. | |
| 7,357,974 | B2 | 4/2008 | Rockwell | |
| 7,506,776 | B2 | 3/2009 | Podd | |
| 7,685,665 | B2 | 3/2010 | Warmuth | |
| 7,748,796 | B2 | 7/2010 | Rockwell et al. | |
| 7,827,753 | B2 | 11/2010 | Nagarajan et al. | |
| D629,556 | S | 12/2010 | Alter et al. | |
| 7,923,092 | B2 | 4/2011 | Rockwell | |
| 2001/0038722 | A1 | 11/2001 | Stone | |
| 2005/0191921 | A1 | 9/2005 | Tilton et al. | |
| 2006/0008614 | A1 | 1/2006 | Rockwell | |
| 2006/0008616 | A1 | 1/2006 | Dean et al. | |
| 2006/0011628 | A1 | 1/2006 | Guevara | |
| 2007/0042156 | A1 | 2/2007 | Rockwell | |
| 2007/0054090 | A1 | 3/2007 | Rockwell | |
| 2007/0212970 | A1 | 9/2007 | Rockwell et al. | |
| 2007/0243366 | A1 | 10/2007 | Tilton et al. | |
| 2007/0272285 | A1 | 11/2007 | Herreman et al. | |
| 2008/0145630 | A1 | 6/2008 | Rockwell | |
| 2008/0289664 | A1 | 11/2008 | Rockwell et al. | |
| 2008/0317996 | A1 | 12/2008 | Rockwell | |
| 2009/0038980 | A1 | 2/2009 | Rockwell et al. | |
| 2009/0094908 | A1 | 4/2009 | Krueger et al. | |
| 2009/0301022 | A1 | 12/2009 | Rockwell et al. | |
| 2010/0024851 | A1 | 2/2010 | Rockwell et al. | |
| 2011/0069498 | A1 | 3/2011 | Alter et al. | |
| 2011/0086214 | A1 | 4/2011 | Rockwell | |
| 2011/0186473 | A1 | 8/2011 | Rockwell | |
| 2011/0233086 | A1 | 9/2011 | Rockwell et al. | |
| 2012/0169194 | A1 | 7/2012 | Maderic et al. | |
| 2012/0298154 | A1 | 11/2012 | Rockwell et al. | |
| 2013/0174435 | A1 | 7/2013 | Rockwell et al. | |
| 2013/0266787 | A1 | 10/2013 | Rockwell et al. | |
| 2013/0337205 | A1 | 12/2013 | Rockwell et al. | |
| 2014/0230497 | A1 | 8/2014 | Rockwell et al. | |
| 2015/0097472 | A1 | 4/2015 | Rockwell | |
| 2015/0218803 | A1 | 8/2015 | Rockwell | |
| 2015/0233110 | A1 | 8/2015 | Alter et al. | |
| 2015/0250375 | A1 | 9/2015 | Rockwell et al. | |
| 2015/0368852 | A1 | 12/2015 | Rockwell et al. | |
| 2016/0101303 | A1 | 4/2016 | Rockwell et al. | |

FOREIGN PATENT DOCUMENTS

| | | | | |
|---|---|---|---|---|
| DE | 102005031487 | | 7/2006 | |
| EP | 0591826 | | 4/1994 | |
| EP | 1751341 | | 1/2011 | |
| JP | 53-133194 | | 11/1978 | |
| WO | 2004103851 | | 12/2004 | |
| WO | 2005100674 | | 10/2005 | |
| WO | WO-2007141329 | A2 * | 12/2007 | D06F 39/001 |
| WO | 2011084953 | | 7/2011 | |

OTHER PUBLICATIONS

International Search Report and Written Opinion from PCT/US11/020124 dated Aug. 4, 2011.
International Search Report and Written Opinion from PCT/US11/020129 dated Mar. 23, 2011.
International Search Report and Written Opinion from PCT/US11/29943 dated Sep. 19, 2011.
Office Action from U.S. Appl. No. 12/984,455 dated Sep. 12, 2013.
Office Action from U.S. Appl. No. 12/984,455 dated Jun. 4, 2014.
Office Action from U.S. Appl. No. 12/984,455 dated Sep. 12, 2014.
Office Action from U.S. Appl. No. 12/984,455 dated Nov. 21, 2014.
Office Action from U.S. Appl. No. 12/984,455 dated Mar. 13, 2015.
Office Action from U.S. Appl. No. 12/984,455 dated Apr. 6, 2016.
Office Action from U.S. Appl. No. 13/499,756 dated Apr. 23, 2015.
Office Action from U.S. Appl. No. 13/499,756 dated Oct. 2, 2015.
Notice of Allowance from U.S. Appl. No. 13/499,756 dated Jul. 27, 2016.

* cited by examiner

APPLIANCE HAVING DAMPENING PORTION

CROSS REFERENCE TO RELATED APPLICATIONS

This application is a continuation of U.S. application Ser. No. 13/499,756, filed Apr. 2, 2012, which is the U.S. national phase entry of PCT/US2011/020124 with an international filing date of Jan. 4, 2011, which claims priority to U.S. Provisional Application No. 61/292,280, filed Jan. 5, 2010, the entire disclosures of which are hereby incorporated by reference.

BACKGROUND

Appliances such as clothes washers and driers, dish washers, etc., must be packaged before they leave a manufacturing facility in a manner that protects them from the hazards of transport until they reach their ultimate destination, which is typically a consumer's home. Along the way, an appliance may be loaded and unloaded from several locations and must be packaged for protection against inadvertent damage. Appliances such as vertical suspension clothes washers include an outer cabinet or housing containing a tub that is suspended in the cabinet and moved relative to the cabinet by a tub drive motor. Washers of this type are well known in the art and it is not unusual for such appliances to occasionally experience damage during shipping. It is also not unusual for such appliances to generate varying levels of sound or noise during operation in the consumer's home.

SUMMARY

Apparatuses and methods relating to appliances are provided. In one embodiment, an appliance having a housing, a moveable tub member inside the housing, and a dampening portion is provided. The housing includes, for example, at least one side wall and the dampening portion disposed at least partially between the moveable tub member and the at least one side wall. The dampening portion includes, for example, a resilient material having at least one surface extending at least partially along the side wall or tub member.

BRIEF DESCRIPTION OF THE DRAWINGS

The accompanying drawings incorporated herein and forming a part of the specification, illustrate several embodiments of the present invention and together with the description serve to explain certain principles of the invention. In the drawings.

DETAILED DESCRIPTION

Figure 1:
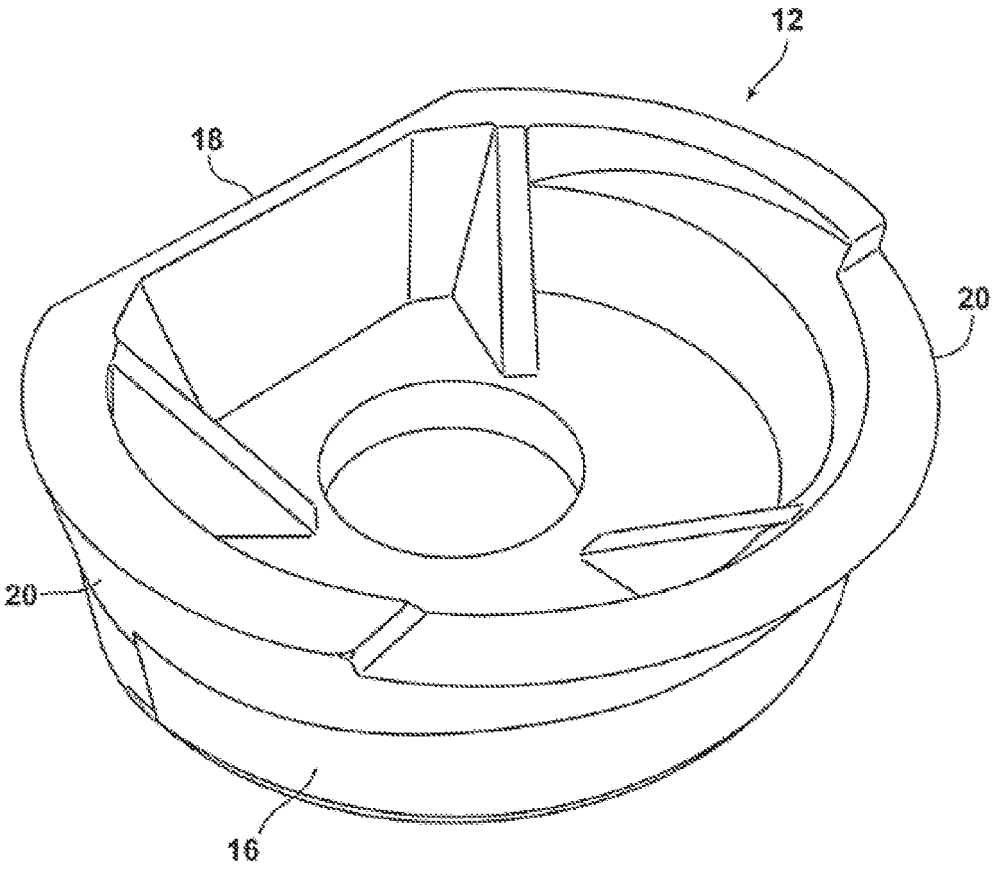
FIG. 1 is a perspective view of one embodiment of a plug that can be used for packaging (shipping), operation damping, or both.

Prior to discussing the various embodiments, a review of the definitions of some exemplary terms used throughout the disclosure is appropriate. Both singular and plural forms of all terms fall within each meaning:

"Physical communication" as used herein, includes but is not limited to connecting, affixing, joining, attaching, fixing, fastening, and placing in contact two or more components, elements, assemblies, portions, or parts. Physical communication between two or more components, etc., can be direct or indirect such as through the use of one or more intermediary components and may be intermittent or continuous.

In accordance with one general embodiment, a combined shipping and operation damping system is provided for a washer including a tub suspended in a cabinet having a top wall, sidewalls, a tub access opening in the top wall, and a lid covering that access opening. The system comprises a removable plug having a first portion contoured to fit snugly in the tub and a second portion contoured to fit snugly in the access opening in the cabinet. In addition the system includes a horizontal energy damping element positioned between the tub and the sidewalls of the cabinet. The removable plug and horizontal energy damping element function together to secure the tub in place in the cabinet during shipping. The removable plug is then removed following shipping and the horizontal energy damping element remains in place to provide vibration damping and acoustic insulation during washer operation.

In accordance with one general embodiment, a method is provided for both shipping and operation damping of a washer including a tub suspended in a cabinet having a top wall, sidewalls, a tub access opening in the top wall, and a lid covering the access opening. The method comprises the steps of (a) positioning a removable plug in the access opening in the tub, the plug being contoured to snugly engage the cabinet and the tub; and (b) positioning a horizontal energy damping element between the tub and the sidewalls of the cabinet. The removable plug and horizontal energy damping element secure the tub in place in the cabinet during shipping. The removable plug is then removed following shipping and the horizontal energy damping element remains in place around the tub to provide vibration damping and acoustic insulation during washer operation.

In accordance with yet another general embodiment, a clothes washer comprises a cabinet including sidewalls, a top wall having an access opening, and a lid covering that access opening. The clothes washer further includes a tub suspended in the cabinet as well as a pump and motor system contained in the cabinet. Further, the clothes washer includes a sleeve of resilient material secured around the tub that provides vibration damping and acoustic insulation.

In accordance with still another general embodiment, a clothes washer is provided comprising (a) a cabinet including sidewalls, a top wall having an access opening, and a lid covering that access opening; (b) a tub suspended in the cabinet; and (c) a pump and motor system contained in the cabinet. The clothes washer further includes a block of resilient material secured to the cabinet. The block of resilient material includes a tub opening. The tub extends through that tub opening.

In accordance with yet another general embodiment, a clothes washer comprises (a) a cabinet including sidewalls, a top wall having an access opening, and a lid covering that access opening; (b) a tub suspended in the cabinet; and (c) a pump and motor system contained in the cabinet. Further, the clothes washer includes a substantially T-shaped pad mounted to each sidewall that provides vibration dampening and acoustic insulation.

Reference is now made to FIGS. 1, 2*a*-2*c*, 3, 4, and 5*a*-5*b* illustrating an embodiment of the combined shipping and operation damping system of the present invention. The shipping and operation damping system includes a removable plug 12 and means for dampening. In one embodiment, the means for dampening is a horizontal energy damping element 14. As will become apparent from the following description, the removable plug 12 and horizontal energy damping element 14 function together to secure a tub means or tub T in place in a means for housing or cabinet C of a washer W during shipping. The removable plug 12 is removed following shipping and the horizontal energy damping element 14 remains in place around the tub T to provide vibration damping and acoustic insulation during washer operation.

As best illustrated in FIG. 1, the removable plug 12 includes a first or lower portion 16 that is sized, shaped, and contoured to fit snugly in the tub of washer W. The plug 12 also includes a second or lower portion 20 sized, shaped and contoured to fit snugly in the opening O provided in the top wall of the cabinet C of washer W (see also FIG. 4). In the illustrated embodiment the second portion 20 includes a flat sidewall segment 18 matching the shape of the opening O that functions to lock the removable plug 12 in position.

Since the plug 12 fits snugly in both the opening O of the cabinet C and the tub T of the washer W, it should be appreciated that the plug functions to substantially prevent horizontal movement of the tub T relative to the cabinet C during shipping or other transport of the washer.

The plug 12 may be made from substantially any appropriate material including but not limited to expanded polystyrene, molded plastic, cardboard, and mixtures thereof.

Figure 2A:
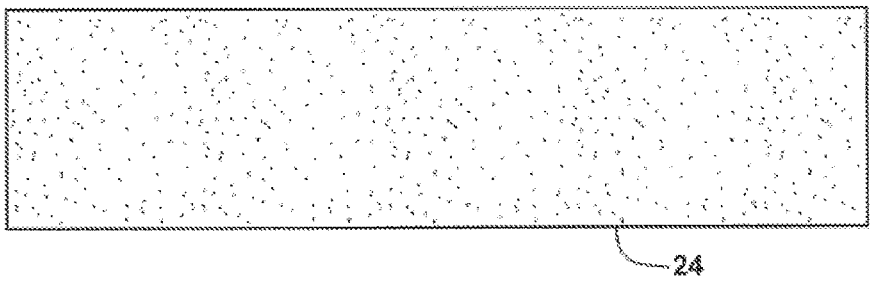
FIGS. 2*a*-2*c* are front plan views of embodiments of a horizontal energy damping element that can be used for packaging (shipping), operation damping, or both.
Figure 2B:
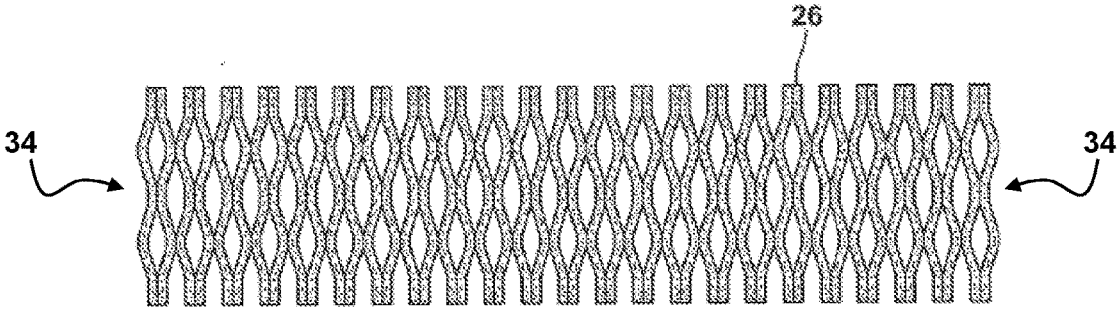
Figure 2C:
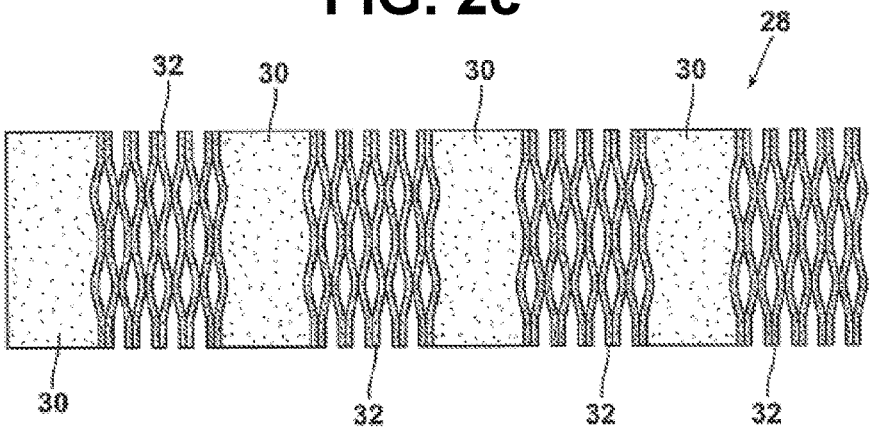
Figure 3:
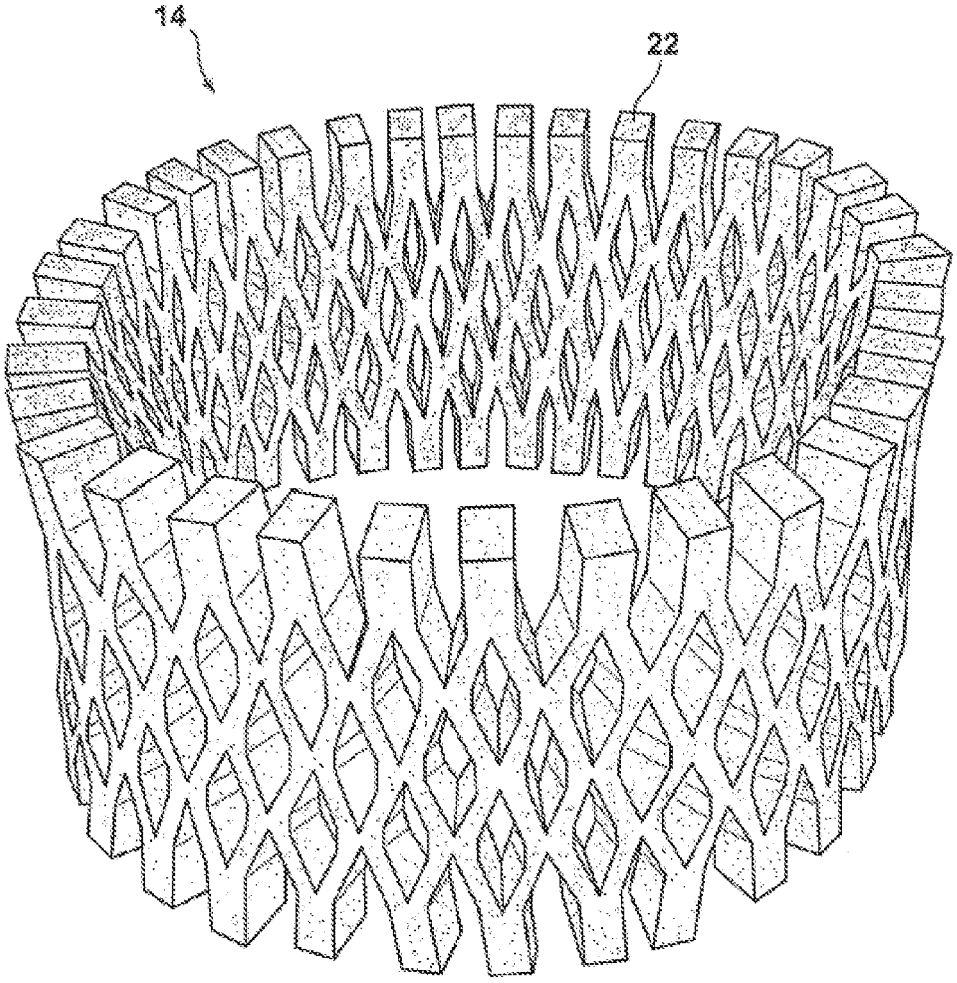
FIG. 3 is a perspective view of the embodiment of FIG. 2*b* formed into one embodiment of a sleeve of the type that is stretched around the tub of the washer in order to form an embodiment of the horizontal energy damping element.
Figure 4:
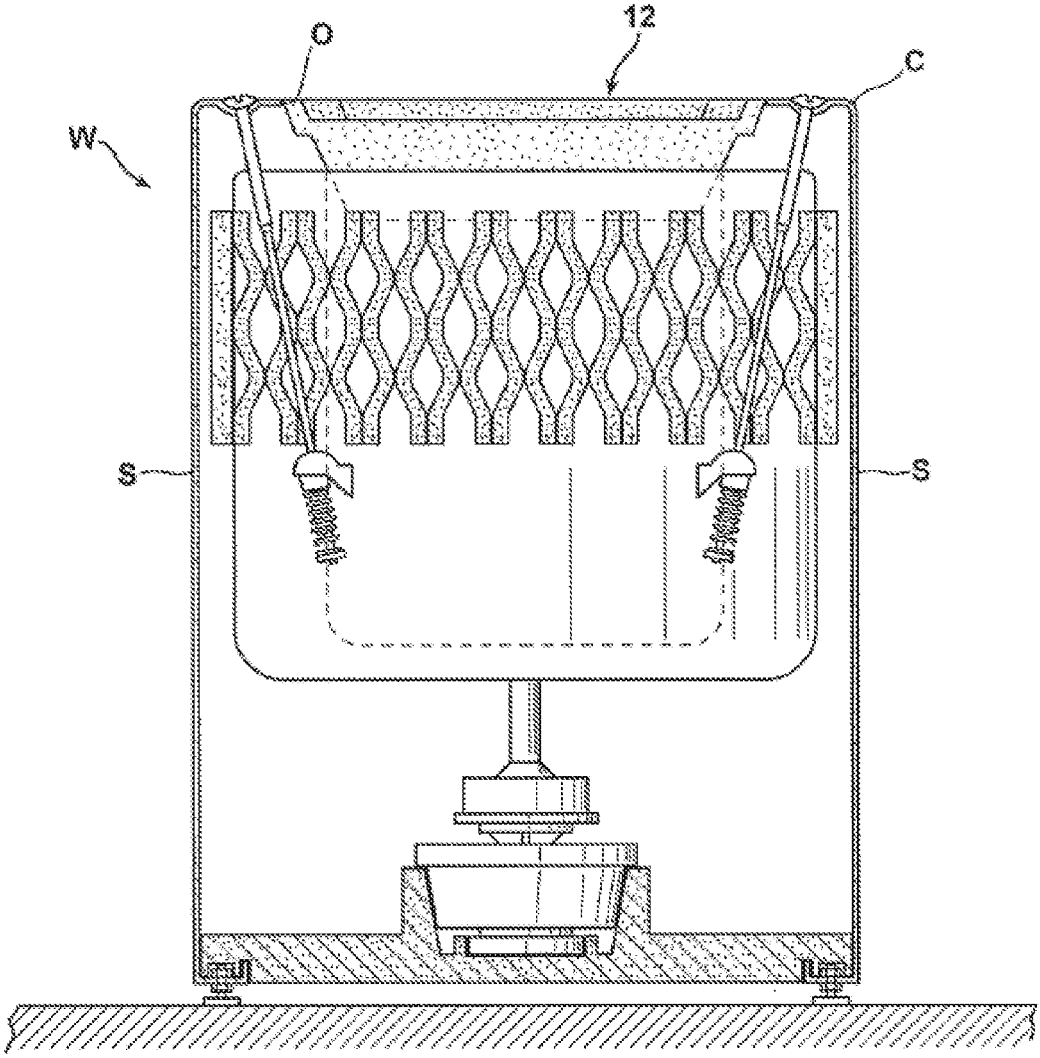
FIG. 4 is a schematical cross sectional view illustrating one embodiment of a combined shipping and operation damping system for protecting the tub of the washer during shipping.

As best illustrated in FIGS. 3 and 4, the horizontal energy damping element 14 comprises a sleeve 22 of resilient material that is, in one embodiment, stretched over and secured around the tub T. The sleeve 22 may be secured in any appropriate manner including by means of mechanical fasteners, an appropriate adhesive, or friction. As best illustrated in FIGS. 2*a*-2*c*, the sleeve 22 may be formed from a solid sheet of resilient material 24, a lattice sheet of resilient material 26, or a combination sheet 28 of solid and lattice sections 30, 32, respectively, of resilient material. Any of the sheets 24, 26, 28 may be formed into a sleeve 22 by abutting and securing the ends of the sheet together by hot welding, adhesive, or other appropriate means. Thus, as illustrated in FIGS. 2*b* and 3, the ends 34 of the sheet 26 may be connected together to form the sleeve 22 of lattice material.

The horizontal energy damping element 14 or sleeve 22 may be made from substantially any appropriate material including, but not limited to, material selected from a group consisting of a polyester, a polyester olefin blend, polyethylene terephthalate, polybutylene terephthalate, a polyethylene terephthalate and polypropylene blend, a polybutylene terephthalate and polypropylene blend, and combinations thereof. As an alternative, the horizontal energy damping element 14 or sleeve 22 may be made from a laminated material including a core layer of fiberglass reinforced polymer material sandwiched between two wear layers of polyester material.

Polyester materials are particularly useful as construction material for the sleeve 22 as they exhibit excellent resiliency and wear resistance to provide a long service life. At the same time, the acoustic properties of the material may be tuned to better control noise and vibration. This may be done by adjusting the density as well as the diameter and length of the fibers utilized in the material.

In addition, it should be appreciated that the horizontal energy damping element 14 or sleeve 22 may be further tuned to provide the desired spring rate for the most effective damping of horizontal energy or motion of the tub T within the cabinet C. Typically, the horizontal energy damping element 14/sleeve 22 provides a spring rate of between about 6.5 and about 102.0 pounds of force per 100 square inches of contact area. However, this is not critical as long as the sleeve provides the appropriate protections during shipping and/or operation. In this regard, a sleeve 22 made from the lattice sheet 26 provides the greatest versatility.

The spring rate range desired for optimum energy dampening is dependent upon the weight of the tub T, the cabinet-to-tub wall gap G (which may be an air gap), and the weight of wet clothes contained in the tub. A gap G is provided between the damping element 14/sleeve 22 and the cabinet sidewalls S so as to not impair the torque movement of the tub T during start and stop movements. In other embodiments, gap G may extend partially or completely along tub T and may or may not be in contact with tub T or the cabinet sidewalls S.

The loft of the material determines how soon the tub T starts meeting resistance to slow the horizontal energy or momentum of the tub as it moves toward contact with the sidewall S of the cabinet C. The more the material of the damping element 14/sleeve 22 is compressed between the tub T and sidewall S during horizontal movements, the higher the spring rate of the material and the stronger the damping of the horizontal energy. Thus, it should be appreciated that the damping element 14/sleeve 22 made from the lattice material 26 may be effectively "tuned" for a number of different applications. By increasing the amount of solid material in the lattice 26 the spring rate may be increased. Conversely, by reducing the amount of solid material in the lattice 26, the spring rate of the material may be reduced. Thus, by selecting a proper lattice and adjusting the loft or thickness of the lattice to between about 20.0 and about 50.0 mm it is possible to tune the spring rate to a desired level for the most efficient and effective damping of horizontal energy. Typically the lattice will include between about 10 and about 90 percent solid material and between about 90 and about 10 percent open space.

Figure 5A:
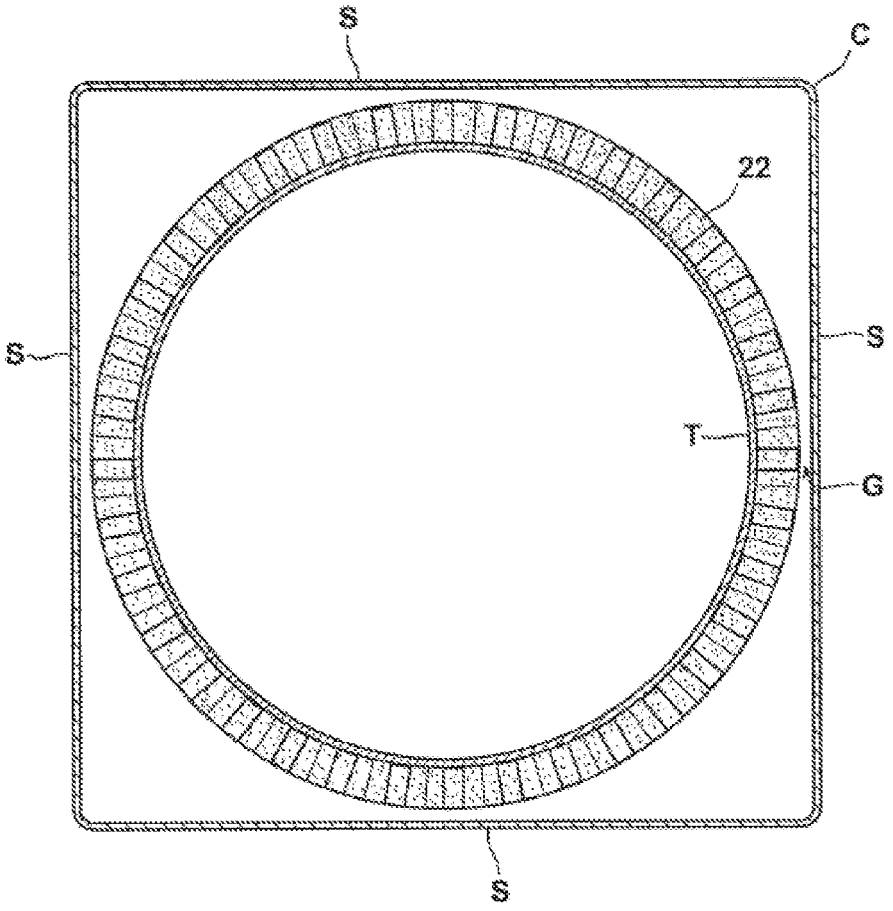
FIG. 5*a* is a view similar to FIG. 4 but showing the plug removed and the horizontal energy damping element in position around the tub to provide vibration damping and acoustic insulation during washing operation.
Figure 5B:
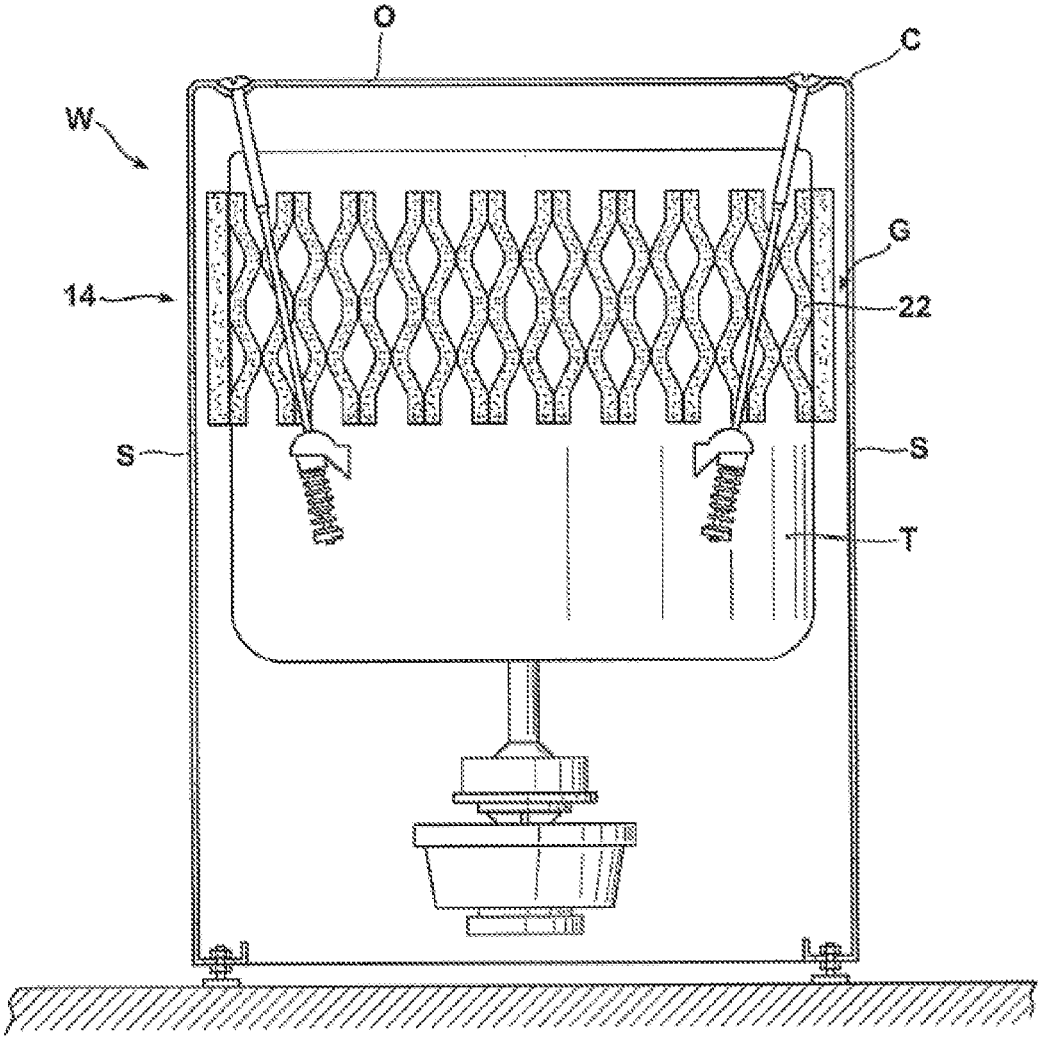
FIG. 5*b* is another cross sectional view illustrating the horizontal energy damping element positioned around the tub so as to be present in the space between the tub and the sidewalls of the cabinet.

As illustrated in FIGS. 4 and 5*b*, damping element 14/sleeve 22 need not extend to the top and bottom of the tub T, but can occupy portions in between. In alternative embodiments, damping element 14/sleeve 22 can extend to the upper and lower extremities of the tub T. Hence, more or less of the tub T can be covered by damping element 14/sleeve 22. Furthermore, damping element 14/sleeve 22 can be made of a plurality of damping elements or sleeves around tub T, which may or may not be adjacent to each other. In this manner, the damping element 14/sleeve 22 can be formed by an assembly of components. Still further, damping element 14/sleeve 22 may extend partially or completely along tub T and may be continuous or discontinuous.

As noted above, the plug 12 and damping element 14 are positioned during packaging as illustrated in FIG. 4 to prevent horizontal shifting of the tub T in the cabinet C during shipping. Once the washer W is positioned in a laundry room or otherwise situated for use, the plug 12 is removed while the damping element 14 remains positioned around the tub T for the life of the washer W (see FIGS. 5*a* and 5*b*). In this manner, the damping element 14 is dual use: shipping and operation. As such, it is not disposed of after shipping has been completed.

During operation, the damping element 14 reduces and controls horizontal motion of the tub T toward the sidewalls S of the cabinet C. This reduces noise and vibration so as to provide smoother and more silent operation. The polyester material of the damping element 14 is very resilient and scuff resistant so as to provide a long service life without any significant degradation of desired damping properties. Other materials may be used which have similar properties.

Figure 6:
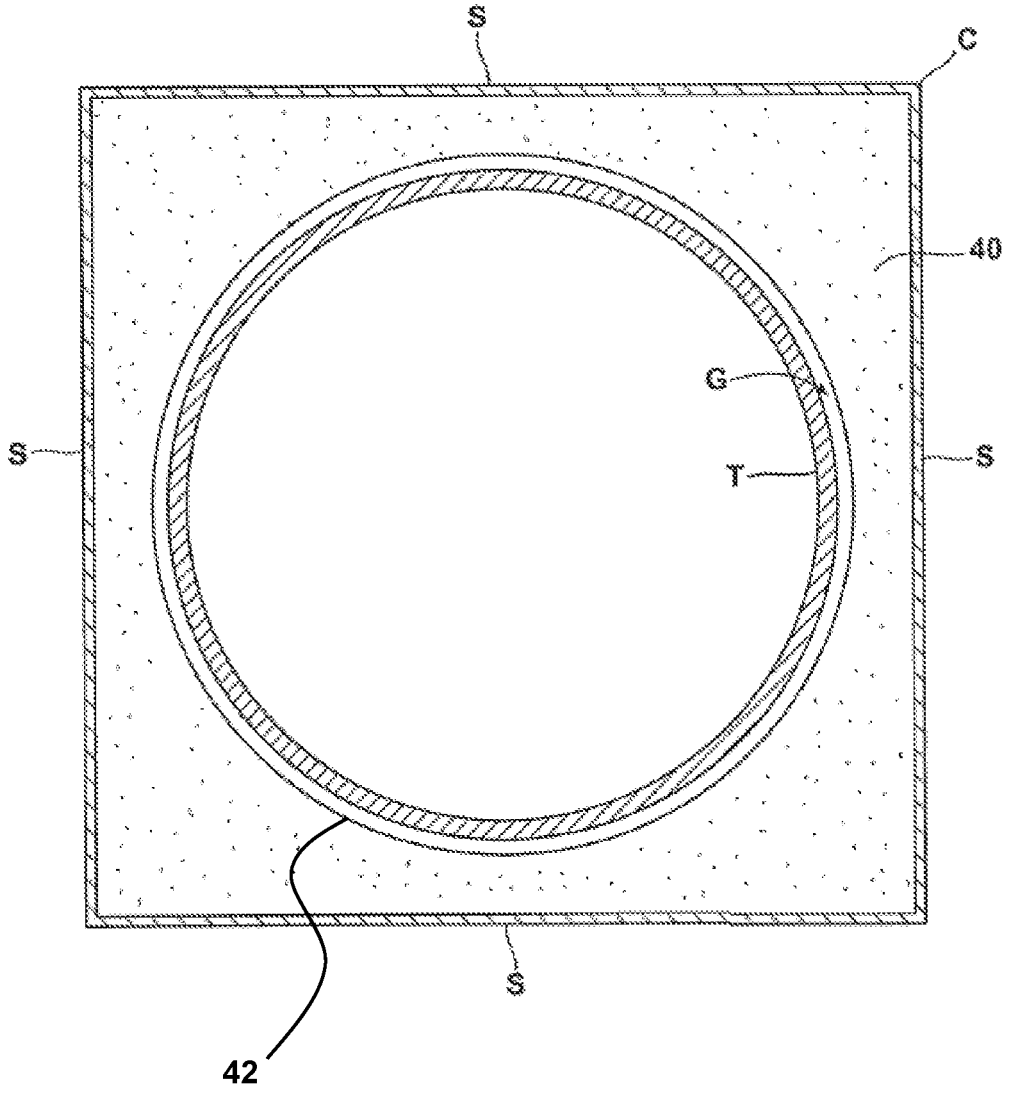
FIG. 6 is a schematical cross sectional view illustrating an alternative embodiment for the horizontal energy damping element.

An alternative embodiment of the means for dampening is a horizontal energy damping element 14 as illustrated in FIG. 6. In this embodiment the horizontal energy damping element 14 comprises a block 40 of resilient material that is secured to the sidewalls S of the cabinet C. The block 40 of resilient material includes a tub opening 42. As should be appreciated the tub T extends through the opening 42. A small space or clearance air gap G is provided between the tub T and the tub opening 42 so that the torque movement of the tub T during start and stop movements is not impaired in any way. In other embodiments, gap G may extend partially or completely along tub T and may or may not be in contact with tub T.

It should be appreciated, however, as the tub T moves horizontally under load from, for example, uneven weight distribution of clothes in the tub T during a spin cycle, the tub T engages and compresses the block 40. The spring rate of the material then dampens that horizontal movement. As described earlier, the block 40 need not extend to the upper and bottom extremities of tub T, but may be positioned at portions in between. In one embodiment, block 40 is secured to the sidewalls S at the same approximate tub location as damping element 14/sleeve 22 in FIGS. 4 and 5*b*.

Figure 7A:
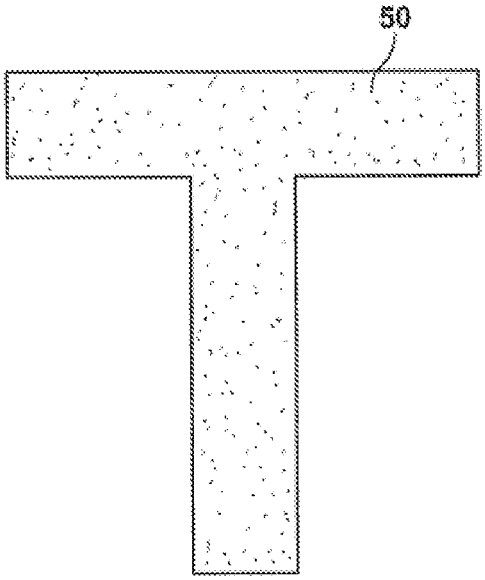
FIG. 7*a* is a front elevational view of yet another alternative embodiment of the horizontal energy damping element in the form of a T-shaped pad.
Figure 7B:
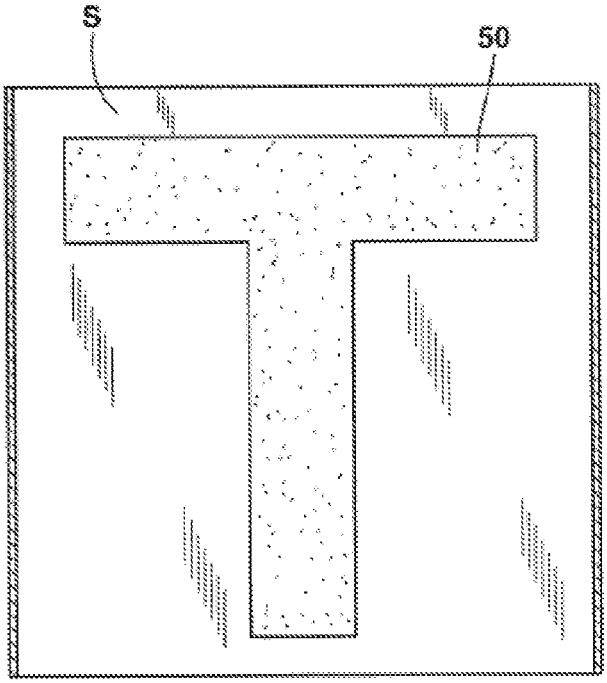
FIG. 7*b* is a detailed partial sectional view illustrating how the T-shaped pad of FIG. 7*a* is mounted to a sidewall of the washer cabinet.

Still another alternative embodiment of the means for dampening is a horizontal energy damping element 14 as illustrated in FIGS. 7*a* and 7*b*. As illustrated in FIG. 7*a*, this embodiment of the horizontal energy damping element 14 comprises a substantially T-shaped pad 50. As illustrated in FIG. 7*b* such a T-shaped pad 50 is mounted to each sidewall S of the washer W. A small space or clearance gap is provided between each of the T-shaped pads 50 and the tub T when the tub T is in its steady state position. However, whenever the tub T moves horizontally under loading during operation of the washer W, the tub T engages one or more of the pads 50, compressing the pad. The spring rate of the material used to construct the pad 50 provides damping of that horizontal energy as the material compresses thereby controlling and limiting horizontal movement and vibration.

The block 40 and T-shaped pads 50 of the two alternative embodiments are made from the same material of the sleeve 22. Thus, each embodiment of the damping element 14 provides the desired resiliency and spring rate for effective damping of horizontal energy and the necessary strength and abrasive resistance to function as desired for a long service life. In other embodiments, pad 50 can be made from different shapes such as, for example an I-shape, only an upper horizontal portion of a T-shape, etc.

In summary, numerous benefits result from employing the concepts of the present invention. The plug and horizontal vibration damping element function together to greatly reduce or otherwise limit horizontal movement of the tub T within the cabinet C of the washer W during shipping. Thus, potential damage to the tub T is prevented as it is transported from one location to another.

Following shipping, plug 12 is removed and the horizontal energy damping element can remain to provide vibration damping during operation. Significantly, by controlling and eliminating undesired horizontal movement of the tub T it is possible to provide a larger capacity tub T within a given size cabinet C. In addition, the material from which the horizontal energy damping element 14 is constructed provides acoustic benefits reducing noise during operation of the washer W.

Still further, the horizontal energy damping element 14 provides improved water management by catching and absorbing water that might be inadvertently spilled from the tub T during operation of the washer W and preventing that water from reaching the floor underneath the appliance. Further, it should be appreciated that the horizontal energy damping element 14 is typically made from a polyester material which is resistant to the growth of bacteria, mildew and mold. Further, the material is hydrophobic by nature and, therefore, dries quickly. In addition, such polyester material provides excellent wear resistance and will provide a long service life.

Figure 8:
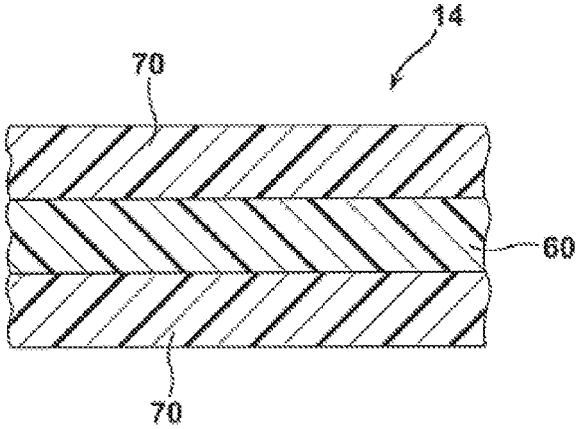
FIG. 8 is a partial cross sectional view of another alternative embodiment of the horizontal energy damping element.

The foregoing description of the preferred embodiments of the present invention has been presented for purposes of illustration and description. It is not intended to be exhaustive or to limit the invention to the precise form disclosed. Modifications or variations are possible in light of the above teachings. For example, each embodiment of the horizontal energy damping element 14 described above is made from a single layer of material. FIG. 8 illustrates an alternative embodiment wherein the horizontal energy damping element 14 is made from a laminate comprising a cure layer 60 of fiberglass reinforced polymer material sandwiched between two wear layers 70 of polyester based material such as the materials used to make the sleeve 22 described above.

The embodiments were chosen and described to illustrate the principles of the invention and its practical application. It is clear that modifications and variations are within the scope of the invention as determined by the appended claims. The drawings and preferred embodiments do not and are not intended to limit the ordinary meaning of the claims in their fair and broad interpretation in any way.

What is claimed:

1. A shipping and operational dampening system comprising:

a housing having a plurality of sidewalls;

a tub disposed within the housing;

a damping member comprising a body of resilient material secured to the sidewalls; and wherein the body includes a tub opening;

wherein the tub extends into the tub opening;

wherein the damping member surrounds an entire circumference of the tub; and wherein an air gap exists between the damping member and the tub, such that the damping member is not connected to the tub.

2. The system of claim 1, wherein the resilient material comprises a material selected from the group consisting of a polyester, a polyester olefin blend, polyethylene terephthalate, polybutylene terephthalate, a polyethylene terephthalate and polypropylene blend, a polybutylene terephthalate and polypropylene blend, and combinations thereof.

3. The system of claim 1, wherein the housing has four sidewalls, and wherein the body is connected to each of the sidewalls.

4. The system of claim 1, wherein the tub extends through the tub opening.

5. The system of claim 1, wherein a height of the body is less than a height of the tub.

6. The system of claim 1, wherein the body is a unitary structure.

7. The system of claim 1, wherein the body contacts a bottom wall of the housing.

8. The system of claim 1, wherein the body contacts a top wall of the housing.

9. The system of claim 1, further comprising a plug for removable engagement with an upper opening in a top wall of the housing and an access opening in the tub.

* * * * *